US006164227A

United States Patent [19]

Itoh

[11] Patent Number: 6,164,227

[45] Date of Patent: Dec. 26, 2000

[54] METHOD FOR SEWING STRETCHABLE CLOTHS BY USING STRETCHABLE CLOTH TAPE, AND STRETCHABLE CLOTH

[76] Inventor: Mitsuru Itoh, Seinan Manshon #604, 8-15, Minamiaoyama 4-chome Minato-ku, Tokyo 107, Japan

[21] Appl. No.: 09/313,217

[22] Filed: May 18, 1999

[30] Foreign Application Priority Data

May 20, 1998 [JP] Japan ..... 10-137869
May 14, 1999 [JP] Japan ..... 11-134433

[51] Int. Cl.[7] ..... D05B 35/02; D05B 35/06

[52] U.S. Cl. ..... 112/475.06; 112/475.09; 112/475.16

[58] Field of Search ..... 112/475.06, 475.09, 112/475.16, 152

[56] References Cited

U.S. PATENT DOCUMENTS

| | | | |
|---|---|---|---|
| 1,862,377 | 6/1932 | Harper | 112/475.09 |
| 3,333,280 | 8/1967 | Hynek et al. | 112/475.09 |
| 3,685,474 | 8/1972 | Frohlich et al. | 112/475.16 |
| 3,718,105 | 2/1973 | Glindmyer | 112/475.16 X |
| 3,965,833 | 6/1976 | Frohlich et al. | 112/475.16 |
| 5,579,709 | 12/1996 | Itoh | 112/475.09 |
| 6,070,542 | 6/2000 | Wong | 112/475.09 |

FOREIGN PATENT DOCUMENTS

| | | |
|---|---|---|
| 791674 | 11/1995 | European Pat. Off. . |
| 1104802 | 4/1961 | Germany . |

*Primary Examiner*—Ismael Izaguirre
*Attorney, Agent, or Firm*—Kanesaka & Takeuchi

[57] ABSTRACT

In a method for sewing stretchable cloths of the invention, one or more stretchable cloths are laminated with a stretchable cloth tape. While the stretchable cloth tape is slightly stretched, first stitches are provided on the stretchable cloth tape to combine the stretchable cloth tape and the first and second stretchable cloths. Also, second stitches are provided between the first stitches and edge portions to connect the stretchable cloth tape, and the first and second stretchable cloths. Accordingly, an entire garment as well as a collar, a zipper portion, a neckline, or the like by using the above method can be finished beautifully with a certain rigidity and flexibility.

19 Claims, 11 Drawing Sheets

METHOD FOR SEWING STRETCHABLE CLOTHS BY USING STRETCHABLE CLOTH TAPE, AND STRETCHABLE CLOTH

BACKGROUND OF THE INVENTION AND RELATED ART STATEMENT

The present invention relates to a method for sewing stretchable cloths by using a stretchable cloth tape, and a specific stretchable cloth. In the method of the invention, an entire garment as well as a collar, a zipper portion, a neckline, or the like can be finished beautifully with a certain rigidity and can function efficiently.

Conventionally, when cloths made from synthetic fibers, such as nylon, rayon, acetate, satin, crepe de Chine and georgette, fabrics woven from natural materials, such as silk and cashmere, and compound materials are sewn to each other to form collars and front facings, for example, in case a collar 70 shown in FIG. 9(*a*) is formed, firstly, a cloth is cut into two pieces (right and left pieces or upper and lower pieces), as shown in FIGS. 9(*b*) through 9(*f*). Since the cut cloths are not laterally symmetrical to each other due to movements of the cloths themselves, a stretchable core piece 72, such as a stretchable bias core piece, a stretchable processed thread core piece, or a stretchable non-woven cloth core piece, which is made of a cloth woven from spandex (stretchable thread) such as Lycra (manufactured by E. I. Du Pont de Nemours & Co., trade name), is thermally adhered to a reverse side of a cloth 71 to thereby make the cloth 71 symmetrical. Then, first stitches 74 are formed by a sewing machine to sew the cloth 71 and the stretchable core piece 72 together, and a cloth 73 is laminated and sewn onto the cloth 71 by applying the second stitches 75 thereon.

However, according to the conventional sewing method, as shown in FIGS. 9(*d*) through 9(*f*), when the lower cloth 73 is laminated on the upper cloth 71 attached with the core piece 72, and sewn thereto by applying the first stitches by a sewing machine, as shown by arrows (solid line arrows in FIGS. 9(*d*) and 9(*e*) indicate directions in which the cloth is pushed, and dotted line arrows in FIGS. 9(*e*) and 9(*f*) indicate sewing directions), the upper cloth 71 with the core piece is pushed backward by "forward feeding" of the cloth by a pressure foot 77 of the sewing machine, and the lower cloth 73 without a core piece is pushed forward by "backward feeding" of the cloth by feeding members 76 of the sewing machine. Thus, the cloths 71, 73 are stretched in the directions opposite to each other. As a result, "twist phenomenon" occurs in the cloths 71, 73, and the cloths are fixed in the stretched condition.

Further, the cloths 71, 73 sewn together by the first stitches 74 are folded back such that inner sides of the cloths orient outwardly, and second stitches 75 are formed on margin portions of the first stitches. Due to the "backward feeding" of the cloth by the feeding members 76 and "forward feeding" of the cloth by the pressure foot 77 as described above, the twist phenomenon occurs in the cloths again, and the cloths are deformed in an S shape. Thus, it is impossible to sew two cloths to be laterally symmetrical. This is a fate of one direction sewing of the sewing machine.

Therefore, by the conventional sewing method, in case the cloths woven by superfine fibers such as Tactel (made by E. I. Du Pont de Nemours & Co., trade name), which is referred to as "Tactel cloth" hereinafter, loose (drooping condition without restoring force) and wrinkled (not stretched tightly) cloths woven from rayon, or smooth cloths such as Burberry cloth and gabardine cloth, are sewn to each other, as described above, since the cloths are sewn in one direction, due to a feed member phenomenon by the sewing machine, displacement in the opposite directions is caused between the upper cloth and lower cloth. Since the cloths are sewn in the displaced condition, cloths after sewn have a twist in one direction. As a result, the cloth is not symmetrical laterally, and in these cloths, there are problems in sewing. Thus, not only these cloths, but collars of garments sewn by the conventional sewing method are sewn asymmetrically more or less.

Also, according to the conventional sewing method, as shown in FIGS. 10(*a*) through 10(*c*), there is caused a so-called "reverse warping phenomenon", in which an opening portion 78, a collar 79 of a suit, and a front facing 80 under buttons are bent or warped.

Thus, according to the conventional sewing method, it is difficult to form symmetrical shirts or collars with beautiful lines by these cloths. Especially, in case a collar cloth with a core piece shown in FIG. 11(*a*) is sewn, as shown in FIG. 11(*b*), the collar cloth 81 is fed and sewn from a joint portion 82 to a point 83 by straight stitches by a sewing machine, not shown. In this case, the collar cloth 81 is fed to a direction shown by an arrow in FIG. 11(*b*) by the feed member of the sewing machine, so that a portion between the joint portion 82 and the point 83 is deformed in a C-shape by shrinking the cloth and core piece thereat. Then, an angle of the cloth is changed at the point 83, and an R portion 84 is sewn to reach a point 85 in an opposite side. Thereafter, an angle of the cloth is changed again at a point 85, and a portion from the point 85 to a joint portion 86 is sewn by straight stitches. At this time, the cloth 81 is deformed in a C-shape at the point 85 as in the point 83. Since the points of the collar are deformed in the same direction, the collar cloth 81 is extremely deformed from the original shape (shown by dotted lines in FIG. 11(*b*)) due to so-called "C & C phenomenon" or "CC phenomenon", in which both sides of the collar become C-shapes. Also, in case the R portion and opening portions of the collar are sewn, the cloth is deformed in a C-shape. Since the collar is adhered and fixed with the adhesive core piece while the collar is being deformed, the collar is not laterally symmetrical.

Furthermore, from a property of the cloth, there are caused a "pulling thread" called as "a pilling phenomenon" wherein the sewing portion is pulled by the threads of the stitches by the sewing machine, and a so-called "twist phenomenon" which is caused by feeding the upper cloth and the lower cloth in the opposite directions by the feed member and the pressure foot of the sewing machine. Therefore, the sewing portion is not finished beautifully.

An object of the present invention is to provide a method for sewing a cloth by using a stretchable tape, wherein in case a cloth woven from superfine fibers such as Tactel cloth, an unstable cloth like a cloth woven from rayon, or a smooth cloth such as Burberry cloth and gabardine cloth (hereinafter referred to as "Burberry cloth or the like") is sewn by using a stretchable core piece, "pilling phenomenon" and "twist phenomenon" do not occur in a sewing portion of the cloth.

Another object of the present invention is to provide a method for attaching a stretchable core piece to a stretchable cloth, wherein a stretchable core piece is used as a lining for all portions of a garment made of the stretchable cloths so that the garment made of the stretchable cloths can have a certain rigidity, flexibility, and can be prevented from being wrinkled and deformed even if the garment is washed in water.

A further object of the invention is to provide a stretchable cloth, wherein when tension is released from the stretchable cloth after the tension is applied to the stretchable cloth, the stretchable cloth returns to an original shape.

Further objects and advantages of the invention will be apparent from the following description of the invention.

SUMMARY OF THE INVENTION

To achieve the above described objects, the present invention provides a method for sewing stretchable cloths, which is formed of: laminating a first stretchable cloth with a core piece disposed on one side of the first stretchable cloth over a second stretchable cloth; laminating a stretchable cloth tape on the first stretchable cloth or the second stretchable cloth while slightly stretching the stretchable cloth tape; providing first stitches on the stretchable cloth tape to combine the stretchable cloth tape and the first and second stretchable cloths along edge portions of the first and second stretchable cloths; folding back at least one of the first and second stretchable cloths along the first stitches; and providing second stitches between the first stitches and the edge portions to connect the stretchable cloth tape, the first and second stretchable cloths and one of the folded first and second stretchable cloths.

In the method for sewing stretchable cloths of the invention, outer surfaces of the first and second stretchable cloths face each other when the first and second stretchable cloths are laminated, and the stretchable cloth tape is stretched by 1/7–1/8 of an original length thereof.

Also, the second stretchable cloth may have a core piece, wherein the core piece on the second stretchable cloth is sewed by the first and second stitches together with the second stretchable cloth. Preferably, the core piece has stretchability and is fixed to the first stretchable cloth by an adhesive.

Also, the present invention provides a method for sewing a collar of a garment, comprising: adhering a first stretchable core piece on a reverse surface of a front collar cloth such that side edges of the first stretchable core piece and the front collar cloth are aligned; laminating stretchable cloth tapes on the first stretchable core piece or a reverse collar cloth along two short side edges situated away from each other; providing first stitches on each of the stretchable cloth tapes to connect each of the stretchable cloth tapes to the reverse collar cloth or the first stretchable core piece with the front collar cloth while stretching the stretchable cloth tapes; laminating the front collar cloth on the reverse collar cloth such that outer surfaces thereof face each other; providing second stitches along the two short side edges and one long side edge of the front collar cloth and the reverse collar cloth to combine the first stretchable core piece, front collar cloth, reverse collar cloth and stretchable cloth tapes; folding back the front collar cloth and the reverse collar cloth along the second stitches; providing third stitches on outer surfaces of the collar cloths between the second stitches and outer edges of the collar; adhering a second stretchable core piece on the reverse collar cloth along a base portion of the collar; and providing fourth stitches on the second stretchable core piece along the base portion of the collar to combine the second stretchable core piece and the front and reverse collar cloths.

In the method for sewing a collar of a garment, each of the stretchable cloth tapes is stretched by 1/7–1/8 of an original length thereof.

Each of the stretchable cloth and the second stretchable core piece may be stretchable mesh cloths woven by stretchable threads fixed to each other at overlapping portions to prevent substantial movements of the threads. Accordingly, the collar shape does not substantially change even if a shirt with the collar is washed by regular water washing.

Further, the present invention provides a method for sewing a zipper tape onto main cloths, comprising: preparing a zipper tape formed of two tape portions, wherein each tape portion has a non-stretchable portion and a stretchable portion situated adjacent to the non-stretchable portion; attaching teeth of a zipper to the non-stretchable portions; and sewing the stretchable portions onto the main cloths while slightly stretching the stretchable portions to increase a length thereof. Here, the stretchable portions are formed of stretchable threads, and are woven with non-stretchable threads forming the non-stretchable portion while the stretchable threads are being stretched.

In the method for sewing the zipper tape, the stretchable portion is sewed to the main cloth while the stretchable portion is stretched by 2 to 4% of an original length thereof.

The present invention further provides a method for sewing stretchable cloths, comprising: laminating an elongated stretchable core piece partly on an elongated stretchable cloth along an edge thereof; folding the elongated stretchable cloth to enclose the elongated stretchable core piece; laminating the folded stretchable cloth on a main cloth; and applying first stitches to connect the elongated stretchable core piece, the main cloth and the elongated stretchable cloth while stretching the elongated stretchable cloth and the elongated stretchable core piece.

In the method for sewing stretchable cloths, the elongated stretchable cloth and the elongated stretchable core piece are stretched by 1/7–1/8 of original lengths thereof when they are sewed to the main cloth.

Zig-zag stitches may be applied on the elongated stretchable core piece when the elongated stretchable core piece is laminated on the elongated stretchable cloth. Also, an edge portion of the main cloth can be enclosed in the folded elongated stretchable cloth. In this case, a part of the elongated stretchable cloth which does not laminate the elongated stretchable core piece is partly folded, and the partly folded elongated stretchable cloth is stitched to the main cloth.

Preferably, the stretchable core piece may be a stretchable mesh tape woven by stretchable threads fixed to each other at overlapping portions to prevent substantial movements of the threads.

In the invention, a stretchable cloth or core piece is formed of stretchable threads woven such that the stretchable threads are fixed to each other at portions where the threads cross each other to prevent substantial movements of the threads. Therefore, when tension is released from the stretchable cloth after the tension is applied to the stretchable cloth, the stretchable cloth returns to an original shape.

In the invention, the stretchable cloth or core piece may be adhered between stretchable cloths used for a front body and a lining of a jacket. Accordingly, a garment containing the stretchable core piece has an elasticity as a whole, while the garment with the stretchable core piece can maintain an original shape even after being used for a certain period of time.

In the invention, since the sewing portion, which tends to shrink by a repulsion force against pulling of a stretchable core piece or stretchable cloth tape woven by a stretchable cloth, such as Lycra, tends to bend in the opposite direction, reverse bending does not occur at the collar connection portion of a shirt, a collar and a front facing under buttons in a jacket. Accordingly, so-called "C&C phenomenon", which normally occurs in the collar and a zipper tape attaching portion, can be prevented, so that the collar and the zipper tape attaching portion are not deformed. As a result, beautiful and sharp points can be formed at the ends of the collar, and the neatly lined clothes can be sewn. Furthermore, since so-called "undulate phenomenon" do not occur in the zipper tape and zipper tape attaching portion, workability of the zipper can be improved.

BRIEF DESCRIPTION OF THE DRAWINGS

FIG. 3(*b*) is an explanatory view showing a garment main body with the zipper tape;

FIG. 5(*b*) is a partly cut explanatory view showing a section taken along line 5(*b*)—5(*b*) in FIG. 5(*a*);

FIG. 5(*c*) is a partly cut explanatory view showing a section in a condition that a core piece 52 is turned at one side and sewn by second stitches 66;

DETAILED DESCRIPTION OF PREFERRED EMBODIMENTS

Figure 1A:
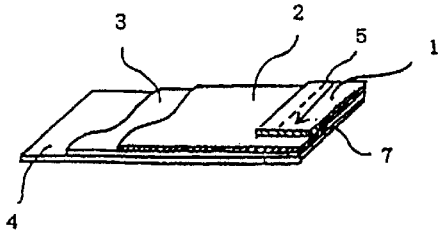
FIGS. 1(*a*) through 1(*e*) are explanatory views schematically showing steps of a first sewing method of the present invention.
Figure 1B:
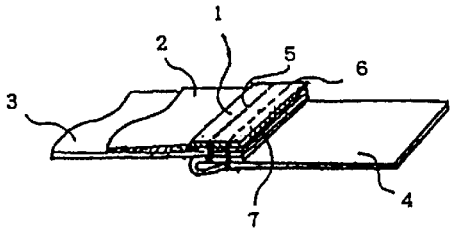
Figure 1C:
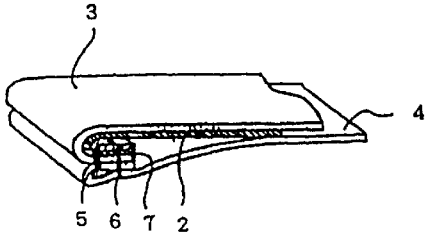
Figure 1D:
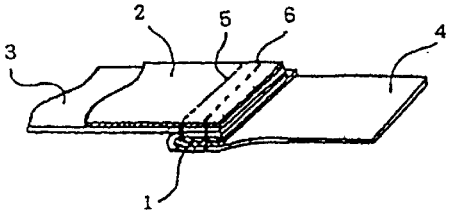
Figure 1E:
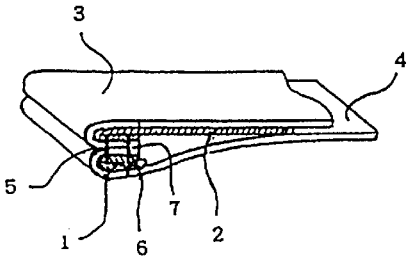
Figure 2A:
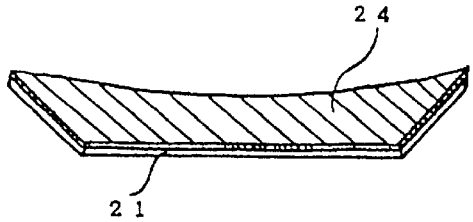
FIGS. 2(*a*) through,2(*e*) are explanatory views schematically showing steps of second sewing method and third sewing method of the present invention.
Figure 2B:
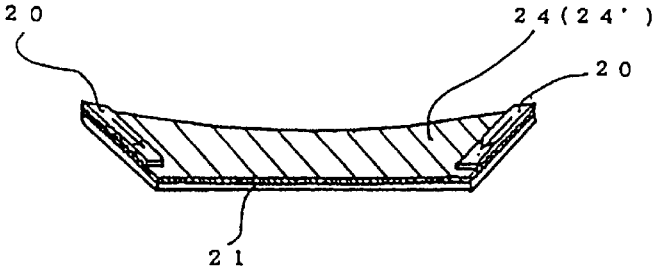
Figure 2C:
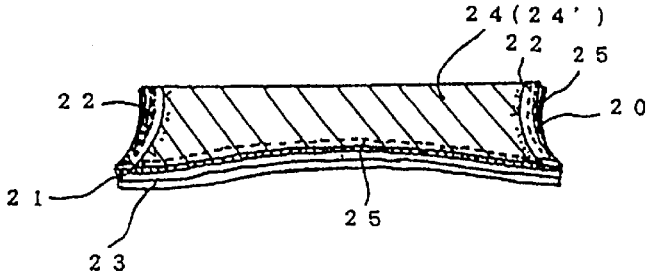
Figure 2D:
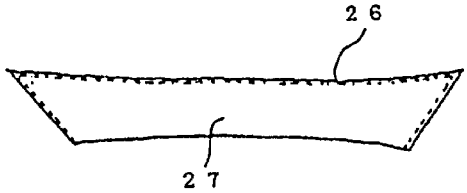
Figure 2E:
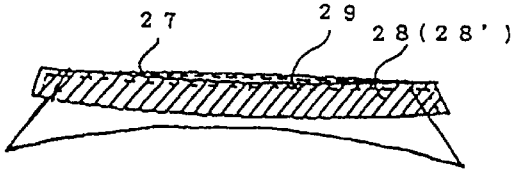

Hereinafter, embodiments of the present invention will be explained with reference to the attached drawings.

FIGS. 1(*a*) through 1(*e*) are explanatory views schematically showing steps of a first sewing method of the present invention.

In the first sewing method of the invention, in case a Tactel cloth or a Burberry cloth is sewn, as shown in FIGS. 1(*a*) through 1(*c*), a cloth 3 having a stretchable core piece 2 adhered on a reverse side thereof, and a cloth 4 which does not have a core piece are laminated with each other. A stretchable cloth tape 1 is stretched by 1/7–1/8 of a length thereof in the longitudinal direction and laminated on a sewing portion of an edge portion of the stretchable core piece 2 adhered to the cloth 3. At the same time, first stitches 5 are formed on the tape 1 to sew two cloths 3, 4 and the stretchable cloth tape 1 together with the core piece 2. Then, the cloth 4 is turned along the first stitches 5, and second stitches 6 are formed between an edge 7 of the cloth and the first stitches on a sewing margin thereof, to thereby sew the cloths 3, 4 together.

In this case, it is important that the stretchable cloth tape 1 is a tape made of a cloth woven from Lycra (hereinafter referred to as Lycra tape) or a tape woven from finished yarns (herein after referred to as finished yarn tape). Also, it is important that the stretchable cloth tape 1 is sewn in the condition that the tape is stretched by 1/7–1/8 of its length in the longitudinal direction. The stretchable cloth tape can be adhered after being stretched in the longitudinal direction.

In the present invention, in case the cloth is folded, only one cloth may be turned at the first stitches 5, or both cloths can be turned.

Also, the stretchable core piece 2 adhered to the cloth 3 may be chosen from a stretchable core piece made of Lycra cloth, a stretchable bias core piece, a stretchable finished yarn core piece, and a stretchable non-woven core piece.

Incidentally, in the present invention, as shown in FIGS. 1(*d*) and 1(*e*), the stretchable cloth tape 1 can be stretched in the longitudinal direction and laminated on a side of the sewing portion of the edge portion of the cloth 4 which does not have the stretchable core piece, or can be adhered after stretched, and then the tape can be sewn by the aforementioned sewing method.

By using the aforementioned sewing method, the sewing portion shrunk by the first stitches can be returned to the original condition by applying the second stitches, and the garment can be finished in the same size as an original pattern.

Also, by sewing the stretchable cloth tape while stretching the same, twist phenomenon and pilling phenomenon in the sewing portion can be prevented.

A second sewing method of the present invention is a method for sewing a collar by using the stretchable cloth tape. As shown in FIGS. 2(*a*) and 2(*b*), firstly, a stretchable core piece 24 is adhered on a reverse side of a front collar cloth 21, and stretchable mesh tapes 20 are stretched by 1/7 to 1/8 of the length thereof in the longitudinal direction and laminated on both side portions of the stretchable core piece 24. Then, first stitches 22 are formed on the stretchable mesh tapes 20 to thereby sew the stretchable mesh tapes 20 to the front collar cloth 21.

Next, as shown in FIGS. 2(*b*) through 2(*d*), the front collar cloth 21 to which the stretchable mesh tapes 20 are sewn is laminated on a reverse collar cloth 23, and second stitches 25 are formed on peripheral edges of the collar cloths to thereby sew the cloths 21 and 23 together with the stretchable mesh tapes 20. Then, the front collar cloth 21 and the reverse collar cloth 23 which become a bag form by the second stitches are turned inside out, and third stitches 26 are formed on a sewing margin of the second stitches 25 to thereby sew together the front collar cloth 21 and the reverse collar cloth 23 again.

Finally, as shown in FIG. 2(*e*), a stretchable mesh core piece 28 is adhered to a rear side of a collar connection portions 27 of the reverse collar cloth 23, and fourth stitches 29 are formed on the mesh core piece 28 to sew together the front collar cloth 21 and the reverse collar cloth 23.

In this sewing method, a stretchable cloth tape is a mesh tape, and the stretchable mesh tape 20 is a Lycra tape or a finished yarn tape. Namely, stretchable threads forming the stretchable mesh tape 20 are tied or fixed together at overlapping or crossing portions of the threads. Thus, the threads do not move or slide relative to each other. In case the stretchable mesh tape 20 is stretched in any direction, the threads are not biased on the tape, and when a stretching force is removed, the stretchable mesh tape 20 returns to the original shape.

Also, it is important to sew the stretchable mesh tape 20 in the condition that the tape is stretched by 1/7 to 1/8 of the length thereof. Incidentally, the stretchable mesh tape 20 can be sewn to either of the front collar cloth 21 and the reverse collar cloth 23. When the stretchable mesh tape is sewn to the cloth adhered with the core piece, the tape abuts against the core piece and sewn thereto.

In the invention, the stretchable mesh core piece 28 adhered and sewn to the collar connection portions 27 is a mesh core piece similar to the stretchable mesh tape 20. Namely, the threads forming the mesh core piece 28 are tied or fixed. Also it is important that the mesh core piece is woven from Lycra threads or the finished yarns.

In case the stretchable mesh core piece 28 is made of threads other than Lycra threads or finished yarns, a twist phenomenon is caused by the feeding members of the sewing machine. Namely, when a regular stretchable cloth is sewed, one side of the cloth is twisted from a point to a joint portion of the collar, and the other side of the cloth is twisted from a joint portion of the collar to a point. Also, since the cloth does not have a restoring force, the cloth can not adapt to movement thereof. Thus, the cloth can not be sewn as desired. By adopting the core piece woven from the cloth made of Lycra and finished yarn for the stretchable mesh core piece 28 wherein the threads are tied together at overlapping or crossing portions, the aforementioned problems can be solved.

Furthermore, it is important that the stretchable tape and the stretchable core piece are made in the form of mesh. Accordingly, the sewing portion can be finished thinly, and when the core piece and the tape are sewn to the cloth 23, a portion enclosed by the cloth 23 can be small. Thus, balanced spring can be achieved by warps or longitudinal threads of the mesh by themselves, resulting in providing an elastic force to the cloth.

As described above, the collar, which can maintain a three-dimensional shape and have neatly lined ends thereof, can be formed.

In a third sewing method of the present invention, after the stretchable core piece 24 is adhered on a reverse side of the front collar cloth 21 as shown in FIG. 2(*a*) in the second sewing method of the invention, a stretchable mesh core piece 24' is further laminated on the stretchable core piece 24. Then, as in the second sewing method, the front collar cloth 21 and the reverse collar cloth 23 are sewn together. Finally, as shown in FIG. 2(*e*), the stretchable mesh core piece 28 is adhered to the connection portions of the sewn collar cloths, and a stretchable mesh core piece 28' is further laminated on the stretchable mesh core piece 28. Then, fourth stitches 29 are formed to sew the cloths 21, 23 and stretchable mesh core pieces together.

In this case, it is important that the stretchable mesh core piece 24', which is further added to the stretchable core piece 24, and the stretchable mesh core piece 28', which is further added to the stretchable mesh core piece 28 adhered to the collar connection portions 27, should be Lycra mesh core pieces, similar to the mesh tape 20, and if the core pieces are not made as in the specific forms, the desired effects can not be obtained. Also, the stretchable mesh core pieces 24' and 28' further added to the preexisting core pieces can be respectively laminated on and adhered to the stretchable core piece 24 adhered on the reverse side of the front collar cloth 21 and the stretchable mesh core piece 28 adhered to the collar connection portions 27, and then sewn together. Alternatively, the further added core pieces can respectively be sewn to the preexisting core pieces without adhering thereto.

As described above, by further adding the stretchable mesh core piece woven from Lycra (Lycra mesh core piece) to the stretchable core piece which is adhered to the front collar cloth and woven from a cloth made of Lycra or finished yarn, and/or the stretchable mesh core piece which is adhered to the collar connection portion and woven from a cloth made of Lycra or finished yarn, deformation of the collar can be more strongly prevented by the double core pieces.

Figure 3A:
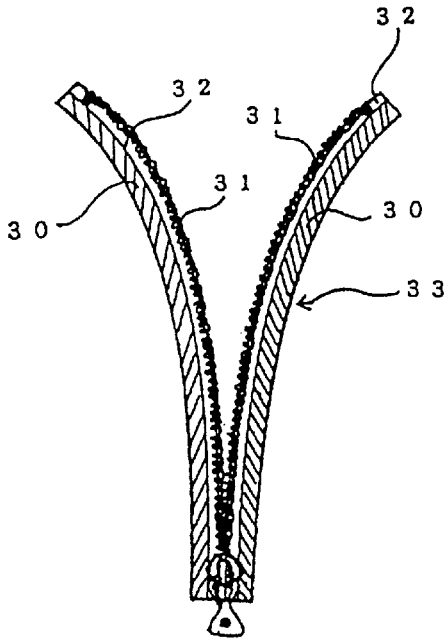
FIG. 3(*a*) is an explanatory view showing a step of sewing a zipper tape according to a fourth method of the present invention.
Figure 3B:
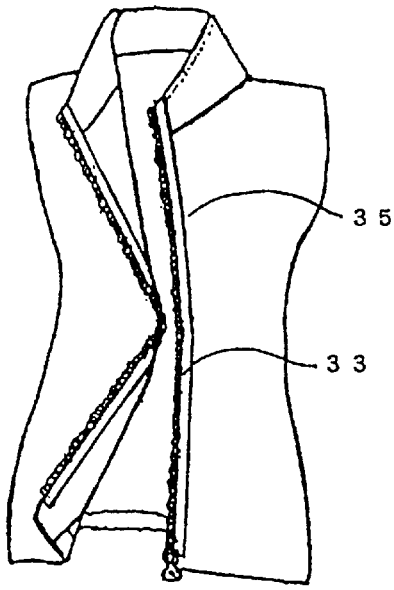
Figure 4A:
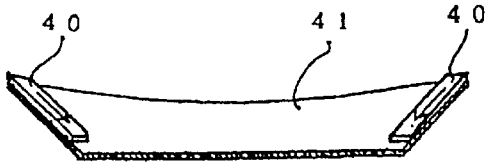
FIGS. 4(*a*) through 4(*h*) are explanatory views showing sewing steps according to a first embodiment of the invention, wherein FIG. 4(*g*) is a partly cut explanatory view showing a section taken along line 4(*g*)—4(*g*) in FIG. 4(*f*), FIG. 4(*i*) is a partly cut explanatory view showing a section taken along line 4(*i*)—4(*i*) in FIG. 4(*h*), and FIG. 4(*j*) is a partly cut explanatory view showing a section taken along line 4(*j*)—4(*j*) in FIG. 4(*h*)
Figure 4B:
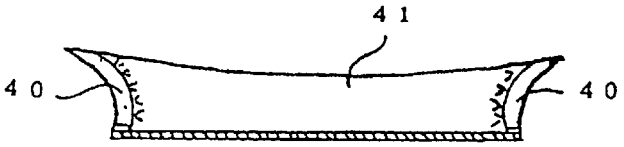
Figure 4C:
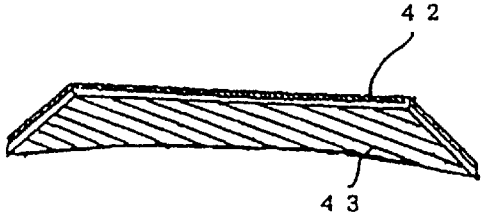
Figure 4D:
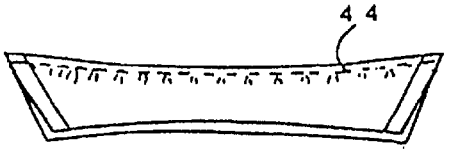
Figure 4E:
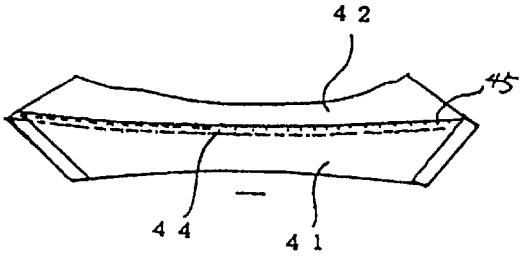
Figure 4F:
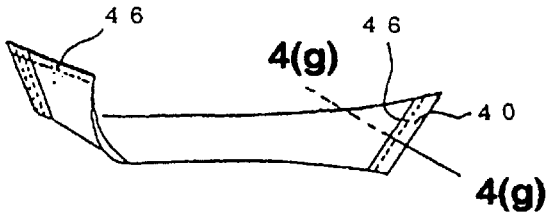
Figure 4G:
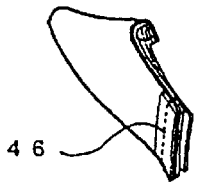
Figure 4H:
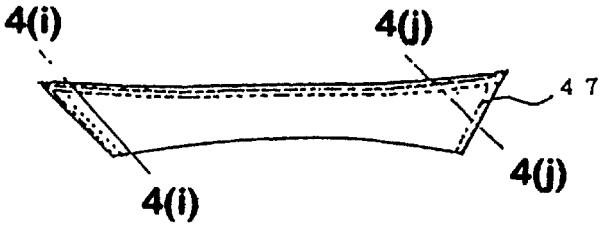
Figure 4I:
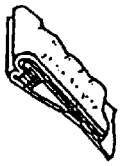
Figure 4J:
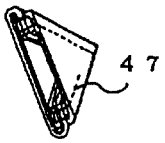

A fourth sewing method is a method for forming a zipper tape and sewing the same to the other cloth. As shown in FIG. 3(*a*), firstly, non-stretchable threads are used in a side in which a slider engaging portion 31 is attached, and stretchable threads are used in a side which is opposite to the slider engaging portion 31, i.e. the side which is sewn to the other cloth such as a garment. While the stretchable threads are stretched, the stretchable threads and the non-stretchable threads are woven into one zipper tape 33, to thereby form the zipper tape 33, which is formed of tape portions 32 made of non-stretchable threads and tape portions 30 made of stretchable threads. Next, the slider engaging portions 31 are attached to the tape portions 32 formed of the non-stretchable threads in a condition that teeth engage with each other, to thereby complete the zipper tape 33 with the slider engaging portions. At this point, since the tape portions 30 made of the stretchable portion are shrunk, both sides of the zipper tape 33 are respectively deformed like a C-shape. Then, in case the zipper tape 33 in which the tape portions 30 formed of the stretchable threads are shrunk is attached to the main cloth such as the garment as shown in FIG. 3(*b*), the tape portions 30 formed of the stretchable threads are stretched in the longitudinal directions, and sewn to zipper attaching portions 35 of the main cloth.

In this method, the stretchable thread is Lycra, and it is important that the tape portion 30 woven from Lycra, i.e. Lycra tape portion, is sewn to the zipper attaching portion of the main cloth while the Lycra tape portion is stretched by 2 to 4% of its length, and preferably, by 3% of its length. In the invention, it is important that the tape is woven from the non-stretchable threads and the stretchable threads (Lycra), so that the woven tape is once shrunk at the portion woven from the stretchable threads, i.e. Lycra tape portion. However, the shrunk tape is stretched at the shrunk Lycra tape portion 30, and at the same time, the stretched Lycra tape portion is sewn to the zipper attaching portion of the main cloth.

As described above, the zipper tape formed by the method of the present invention is sewn to the zipper attaching portion of the cloth according to the method of the present invention, so that the zipper portion can be made as in the original pattern. Also, a so-called "undulate phenomenon", in which the zipper tape is undulated or waved, does not occur, resulting in obtaining beautifully finished zipper tape which can be operated smoothly.

A fifth sewing method is to sew a stretchable cloth tape 101, i.e. so-called binder tape, which encloses an elongated stretchable mesh core piece 104 therein, to a stretchable main cloth 103 as shown in FIG. 6(*a*). Here, the binder tape or stretchable cloth tape 101 is used for finishing an arm or sleeve hole, a neckline or the like of a garment 102 such as a T-shirt, an underwear, and a vest. The stretchable mesh core piece 104 is made of stretchable threads, as in the stretchable mesh tape 20.

In this method, as shown in FIG. 6(*b*), one side of the stretchable cloth tape 101 is firstly folded to define a folded portion 101*a*, and the elongated stretchable mesh core piece 104 made of stretchable threads like Lycra is placed at the other side of the stretchable cloth tape 101 to be aligned thereat. In this method, the stretchable core piece 104 has a width smaller than that of the stretchable cloth tape 101. Then, as shown in FIG. 6(*b*), the stretchable cloth tape 101 with the stretchable core piece 104 is placed under the main cloth 103 in the condition that a front side 103*a* thereof is faced up, and the stretchable cloth tape 101 is further folded to sandwich an edge of the main cloth 103. Then, the folded stretchable cloth tape 101 and the stretchable core piece 104 are integrally stretched by 1/7–1/8 of lengths thereof in an arrow direction shown in FIG. 6(*c*), and stitches 105 are applied at the folded portion 101*a* of the stretchable cloth tape 101 while being stretched as described above. Here, the original lengths of the stretchable cloth tape 101 and the stretchable mesh core piece 104 are shorter than a length of the main cloth 103 at the arm hole or the neckline in which the stretchable cloth tape 101 including the stretchable core piece 104 is provided as the binder tape.

In the fifth sewing method, as shown in FIGS. 6(*d*) and 6(*e*), the stitches 105 can be applied by a binder sewing machine so that stitches 105*a* shown in the front side 103*a* of the main cloth 103 are two straight line stitches and stitches 105*b* shown in a rear side 103*a* of the main cloth 103 are zig-zag stitches.

After the stretchable cloth tape 101 with the stretchable core piece 104 as the binder tape is sewn to the main cloth 103 at the arm hole or the neckline by the aforementioned method, the arm hole or the neckline is slightly shrunk as shown in FIGS. 6(*d*) and 6(*e*). This is because a portion such as a neckline of a T-shirt, an underwear or the like tends to expand by a use and sometimes loses its original shape-line, so that the neckline is required to have elasticity, rigidity and returning force for returning to an original length when an external stretching force is released. Since the stretchable cloth tape 101 including the stretchable mesh core piece 104 therein is stretched and sewn to the neckline of the garment 102, the neckline has a certain rigidity due to the stretchable core piece 104, and can be easily expanded in use because the stretchable cloth tape is used at the portion of the neckline. Nonetheless, since the stretchable cloth tape 101 and the stretchable core piece 104 are sewn to the main cloth 103 while being stretched, the original shape-line of the neckline can be maintained by returning force of the stretchable cloth tape 101 and the stretchable core piece 104 even after the garment 103 is used for a long period of time.

A sixth sewing method is to sew a stretchable cloth tape 111 with an elongated stretchable mesh core piece 114 enclosed therein to a stretchable main cloth 113 of a garment 112 such as a T-shirt, an underwear, a vest or the like as shown in FIG. 7(*a*). The sixth sewing method is different from the fifth sewing method in that the stretchable cloth tape 111 does not enclose an edge of the main cloth 112, and an edge of one side of the stretchable cloth tape 111 is not folded in advance.

In the sixth sewing method, the elongated stretchable mesh core piece 114 similar to the mesh core piece 104 and having a width smaller than the stretchable cloth tape 111 is firstly placed on the stretchable cloth tape 111 as shown in FIG. 7(*b*), and the stretchable cloth tape 111 is folded to enclose the stretchable mesh core piece 114.

Then, the folded stretchable cloth tape 111 including the stretchable core piece 114 therein is placed on an edge of the stretchable main cloth 113 to align the edge of the stretchable main cloth 113 and edges of the folded stretchable cloth tape 111, and stretched by 1/7–1/8 of lengths thereof in an arrow direction as shown in FIG. 7(*c*). Then, stitches 115 are applied at the edges of the folded stretchable cloth tape 111 and the main cloth 113 to connect them. As in the fifth sewing method, the original lengths of stretchable cloth tape 111 and the stretchable core piece 114 are shorter than a length of the main cloth 113 at the neckline. The stitches 115 can be the same as in the stitches 105 in the fifth sewing method, or can be zig-zag stitches.

Alternatively, in the sixth sewing method, when the stretchable core piece 114 is firstly placed on the stretchable cloth tape 111, auxiliary stitches 116 can be applied to combine the stretchable core piece 114 and the stretchable cloth tape 111 as shown in FIG. 7(*e*), wherein the auxiliary stitches 116 are zig-zag stitches. In this case, since the stretchable core piece 114 and stretchable cloth tape 111 are sewn together, when the stretchable cloth tape 111 and the stretchable core piece 114 are stretched while the folded cloth tape 111 enclosing the stretchable core piece 114 is sewn to the main cloth, they can be easily stretched.

In the sewing methods as described above, the stretchable mesh core pieces made of Lycra are used in most cases. The stretchable mesh core piece can be simply placed on the stretchable cloth to be sewn thereto, or attached by an adhesive or the like. Accordingly, the present invention further provides methods for attaching the stretchable core piece to the stretchable cloth in the above sewing methods. Also, there is provided a method for using a stretchable core piece as a lining.

An example shown in FIG. 8(*a*) is a stretchable cloth provided with a stretchable core piece as a lining. Firstly, a stretchable core piece 121 made as in the stretchable core piece 104 is placed on a front surface 122*a* of a stretchable cloth 122 used as a front collar cloth in case of sewing a collar. The stretchable core piece 121 is not adhered to the front surface 122*a* of the stretchable cloth 122 and sewn thereto as in the second sewing method of the invention so that one surface of the stretchable core piece 121 and the front surface 122*a* face each other. Thus, when the front surface 122*a* is folded over so as to orient outside, the stretchable core piece 121 can function as a reverse collar cloth or lining. This method can be used even when the stretchable cloth tape is not used for sewing stretchable cloths.

An example shown in FIG. 8(*b*) shows a method for adhering the stretchable core piece 121 to the stretchable cloth 122 by using an adhesive sheet 123 in case of sewing a collar 130. In this method, the stretchable cloth 122, the adhesive sheet 123 and the stretchable core piece 121 are laminated in order, and the stretchable core piece 121 is adhered to the stretchable cloth 122 by the adhesive sheet 123 interposed therebetween. The adhesive sheet 123 is very thin and thermally adhesive. Also, FIG. 8(*c*) shows an example for preparing a front facing 129 according to the same method as in FIG. 8(*b*). In FIG. 8(*c*), a stretchable cloth 125, the adhesive sheet 123 and the stretchable mesh core piece 121 for the front facing 129 are laminated and connected together.

FIGS. 8(*d*) and 8(*e*) show a half body portion, a sleeve and a collar portion of a jacket 126 provided with stretchable core pieces 121 as a lining by using the above method. As shown in FIG. 8(*e*), the stretchable core piece 121 is provided as a lining of the jacket 126, and a stretchable cloth 128 with an adhesive is separately provided at a lower portion of the front facing 129. In an example of FIG. 8(*d*), a stretchable cloth tape 127 is provided with an adhesive and adhered to an upper portion of the front facing 129 and the collar 130. Numeral 131 is a front cloth. As shown in the figures, the lower portion of the front facing 129 is not provided with the stretchable core piece.

The stretchable core piece 121 used in the invention and shown in FIG. 8(*f*) is woven like a fish net, so as to have excellent stretchability and stability. Namely, threads forming the stretchable core piece 121 are tied or joined at overlapping or crossing portions of the threads. The stretchable core piece can be made of Lycra or other stretchable threads. Accordingly, when the stretchable core piece is attached on an entire area of a reverse side of the stretchable main cloth, the stretchable main cloth does not curl. Also, when the stretchable mesh core piece is used in the entire garment such as a jacket, the finished jacket made of the stretchable cloth, which is normally required to be washed by dry cleaning, can be washed in water without being wrinkled. Accordingly, treatment for the garment made of the stretchable cloth can be facilitated, and the garment washable in water can contribute to reducing excessive use of dry cleaning which causes environmental problems.

In the aforementioned methods and structures, no deformation occurs in the respective sewing portions, and especially, so-called "C & C phenomenon" at the collar portion and so-called "reverse warping phenomenon" at the front facing can be prevented. Thus, the neatly shaped collar and facing can be sewn. Furthermore, "puckering phenomenon" and "pilling phenomenon" at the sewing portions can be prevented. Also, "undulate phenomenon" at the zipper tape portion is prevented, so that the beautifully finished zipper tape can be made.

Hereinafter, other embodiments of the present invention will be explained by referring to other examples, but the present invention is not limited to these examples.

Embodiment 1

According to the sewing method of the invention, an upper collar of an open-neck shirt is sewn by a Tactel cloth by using stretchable tapes. FIGS. 4(*a*) through 4(*f*) and 4(*h*) are explanatory views for explaining steps for sewing the upper collar; FIGS. 4(*g*) is a partly cut explanatory view showing a section taken along line 4(*g*)—4(*g*) in FIG. 4(*f*); FIG. 4(*i*) is a partly cut explanatory view showing a section taken along line 4(*i*)—4(*i*) in FIG. 4(*h*); and FIG. 4(*j*) is a partly cut explanatory view showing a section taken along line 4(*j*)—4(*j*) in FIG. 4(*h*).

Firstly, as shown in FIG. 4(*a*) and FIG. 4(*b*), Lycra tapes 40 are respectively laminated and adhered on both sides of a front collar cloth 41 made of a Tactel cloth under condition that the Lycra tapes are stretched by 1/7 to 1/8 of the length thereof in the longitudinal direction (FIG. 4(*b*)). Then, as shown in FIG. 4(*c*) and FIG. 4(*d*), a reverse collar cloth 42 having a reverse side adhered with a stretchable finished thread core piece 43 is laminated under the front collar cloth 41, and first stitches 44 are formed to sew the cloths 41 and 42 together.

Next, as shown in FIG. 4(*e*) and FIG. 4(*f*), two cloths 41 and 42 are opened along the first stitches 44, and second stitches 45 are formed on the margin of the first stitches 44. The cloths 41 and 42 are folded again inwardly to face each other. Then, third stitches 46 are applied on the Lycra tapes 40. Here, as shown in FIG. 4(*h*), the cloths 41 and 42 are turned again, and placed to face the reverse collar cloth 42 down. Then, fourth stitches 47 are formed to sew the front collar cloth 41 and the reverse collar cloth 42 together, to thereby complete the upper collar.

The upper collar completed as described above is finished laterally symmetrically as measured, and "warp phenomenon" does not occur at the ends of the'collar. Also, the points of the collar can be sharply formed and there is no problem due to "C & C phenomenon". Further, "pilling phenomenon" and "twist phenomenon" do not occur at the sewing portion, so that extremely excellent finish can be achieved as compared to the conventional sewing method.

Embodiment 2

According to the sewing method of the invention, a collar facing and an under-button facing in a jacket made of a Tactel cloth are attached to a main body of the jacket by using the stretchable core piece tape.

Figure 5A:
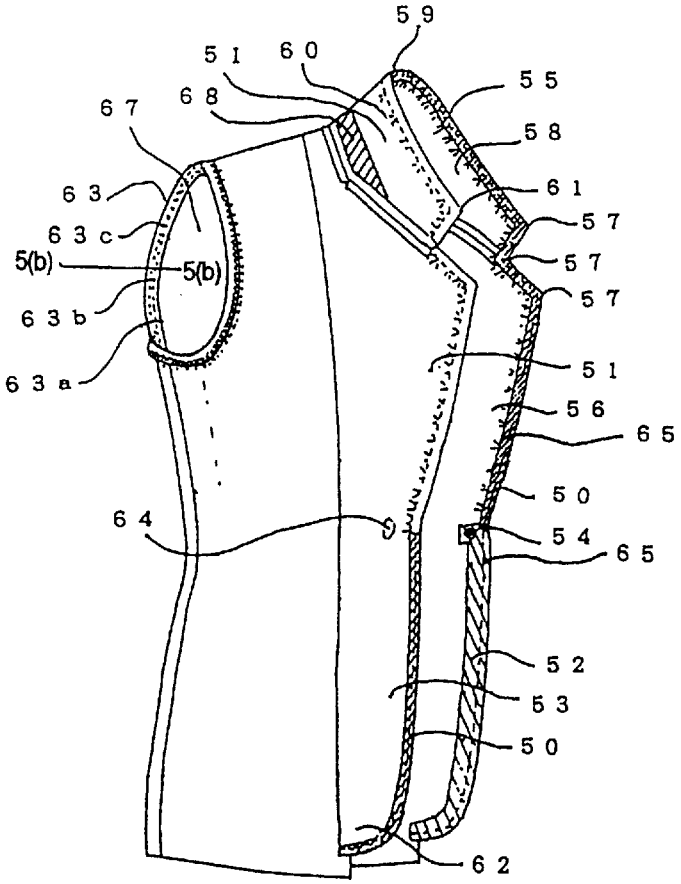
FIG. 5(*a*) is an explanatory view showing sewing steps according to a second embodiment of the invention.
Figure 5B:
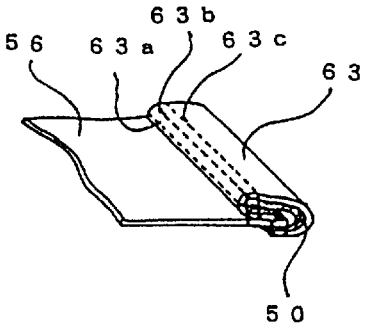
Figure 5C:
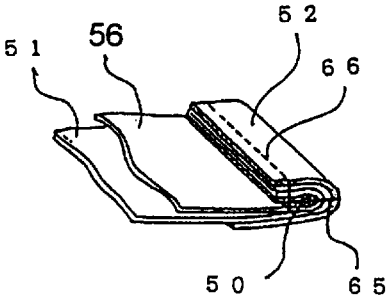
Figure 6A:
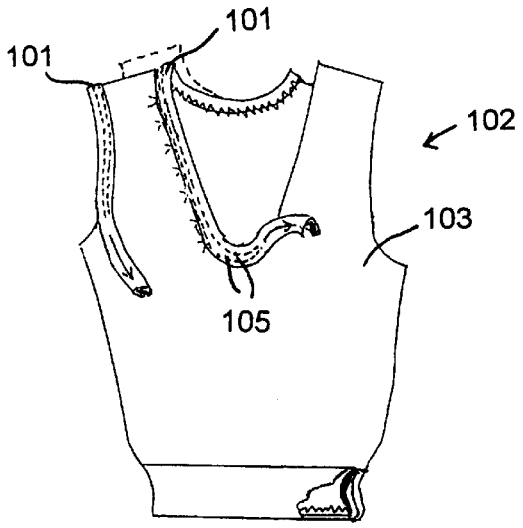
FIGS. 6(*a*) through 6(*e*) are explanatory views schematically showing sewing steps according to a fifth sewing method of the present invention.
Figure 6B:
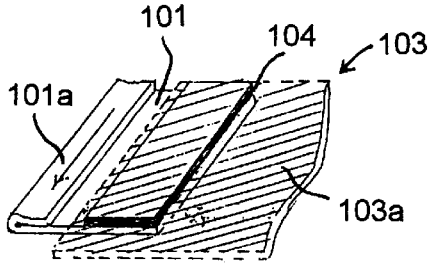
Figure 6C:
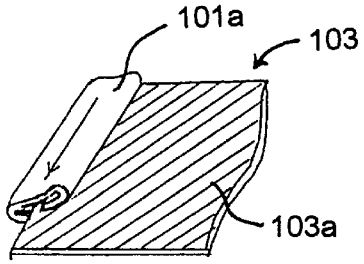
Figure 6D:
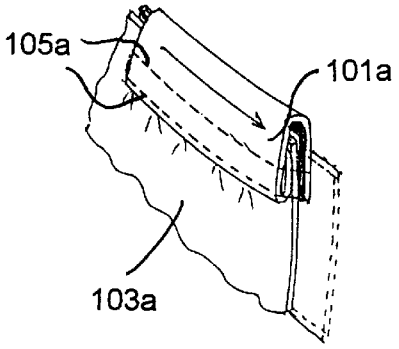
Figure 6E:
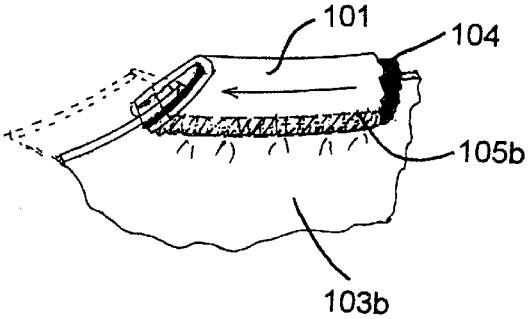
Figure 7A:
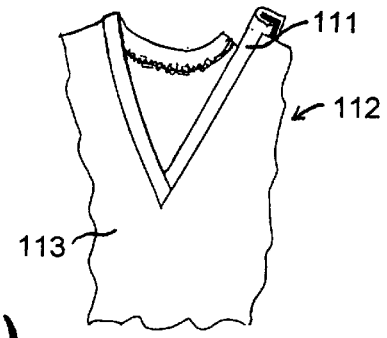
FIGS. 7(*a*) through 7(*g*) are explanatory views schematically showing sewing steps according to a sixth sewing method of the invention.
Figure 7B:
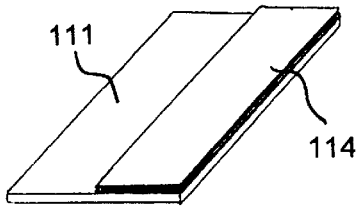
Figure 7E:
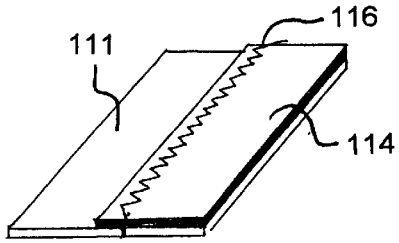
Figure 7C:
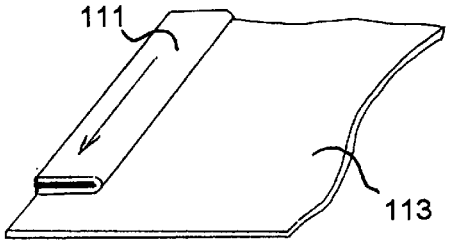
Figure 7F:
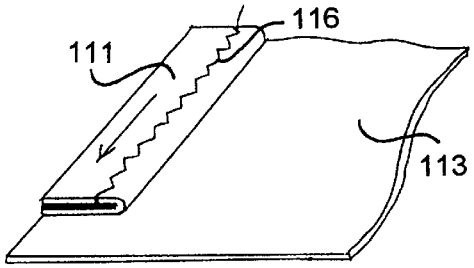
Figure 7D:
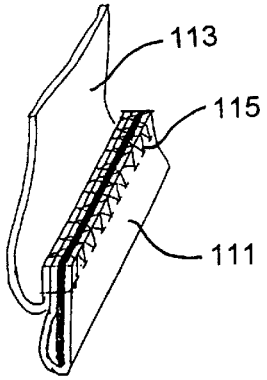
Figure 7G:
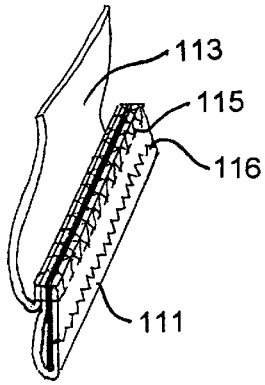
Figure 8A:
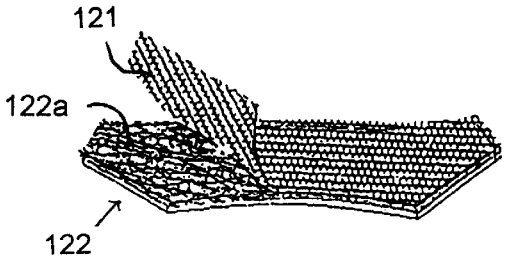
FIGS. 8(*a*) through 8(*f*) are explanatory views schematically showing examples for attaching a stretchable core piece to a stretchable cloth.
Figure 8B:
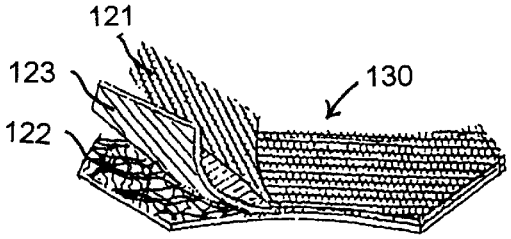
Figure 8C:
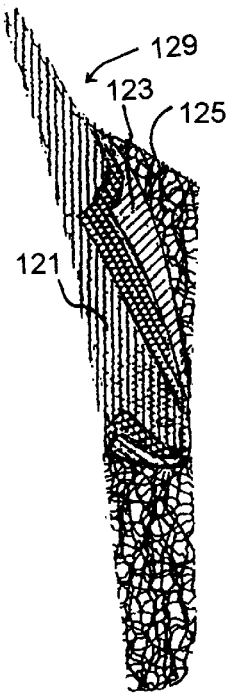
Figure 8F:
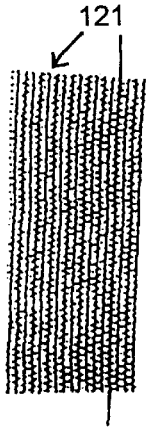
Figure 8D:
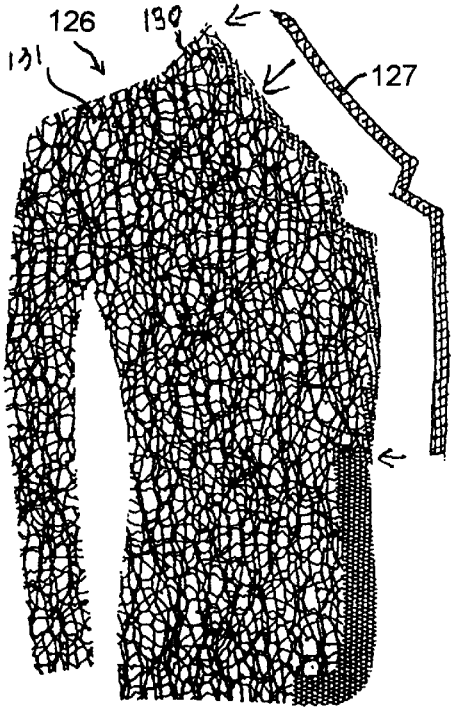
Figure 8E:
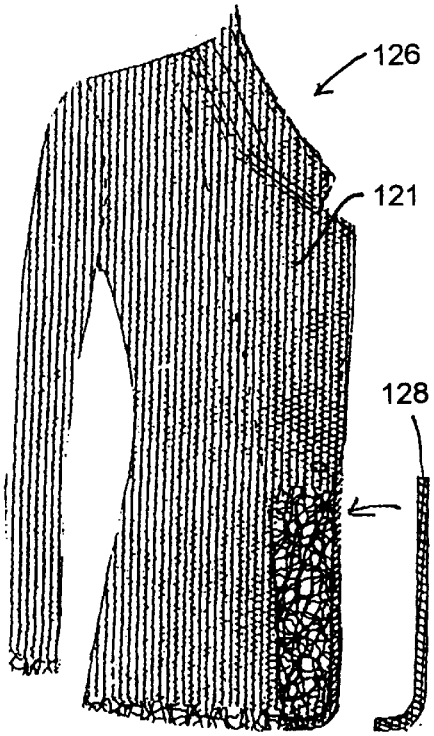
Figure 9A:
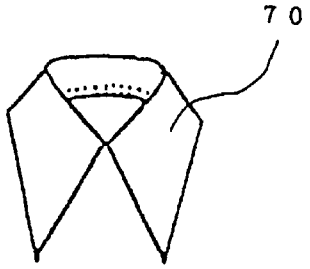
FIG. 9(a) PRIOR ART
FIGS. 9(*a*) through 9(*f*) are explanatory views showing a case of sewing a collar according to a conventional sewing method.
Figure 9B:
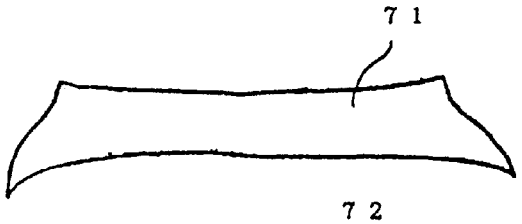
FIG. 9(b) PRIOR ART
Figure 9C:
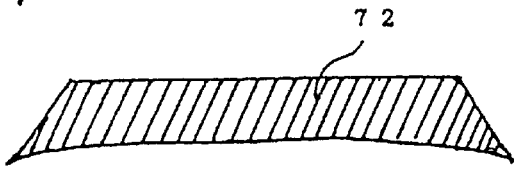
FIG. 9(c) PRIOR ART
Figure 9D:
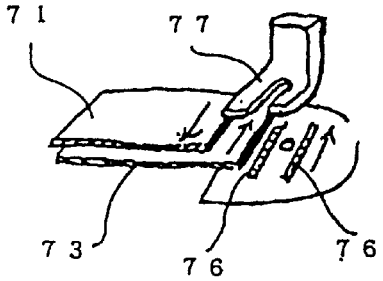
FIG. 9(d) PRIOR ART
Figure 9E:
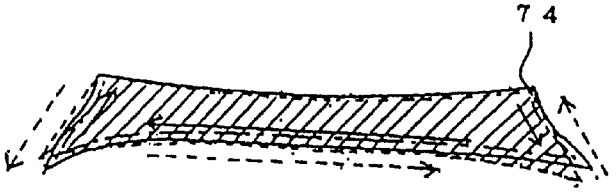
FIG. 9(e) PRIOR ART
Figure 9F:
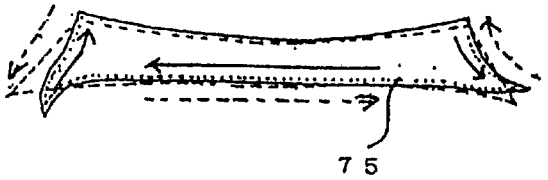
FIG. 9(f) PRIOR ART
Figure 10A:
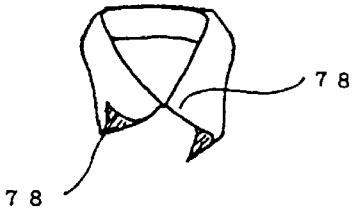
FIG. 10(a) PRIOR ART
FIGS. 10(*a*) through 10(*c*) are explanatory views showing a warp phenomenon occurred in a collar, a collar facing. portion, and a front facing under buttons sewn by the conventional sewing method.
Figure 10B:
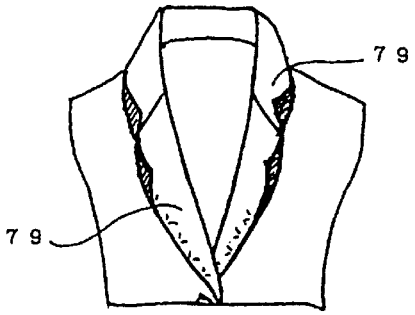
FIG. 10(b) PRIOR ART
Figure 10C:
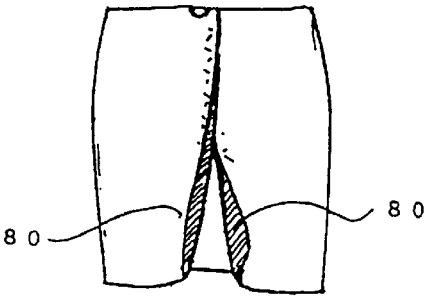
FIG. 10(c) PRIOR ART
Figure 11A:
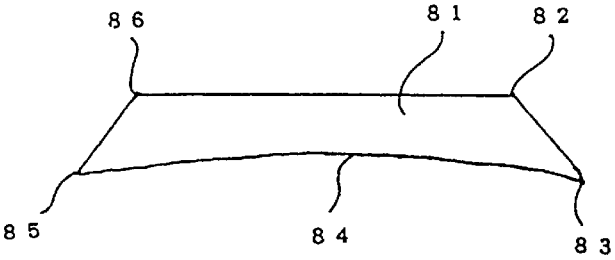
FIG. 11(a) PRIOR ART
FIGS. 11(*a*) and 11(*b*) are explanatory views showing a C&C phenomenon in the collar caused by the conventional sewing method.
Figure 11B:
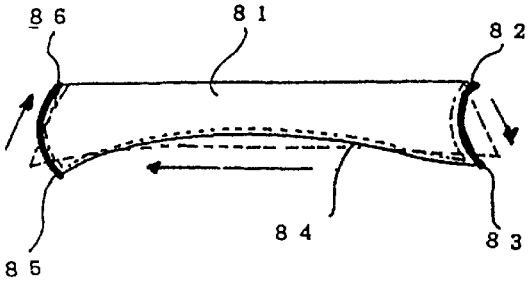
FIG. 11(b) PRIOR ART

FIG. 5(*a*) is an explanatory view for schematically explaining sewing steps in case the collar facing and the under-button facing are attached to the main body of the jacket by using a sewing method of the invention; FIG. 5(*b*) is a partly cut explanatory view showing a section taken along line 5(*b*)—5(*b*) of a sewing portion 63 of an arm hole 67 in FIG. 5(*a*); and FIG. 5(*c*) is a partly cut explanatory view showing a section in a condition that a finished thread core piece 52 is turned and sewn by second stitches 66.

Firstly, as shown in FIG. 5(*a*), stretchable finished thread core pieces 52 are adhered to peripheral edges of facings 51 of both collars of the jacket made of the Tactel cloth, and a body portion 56 and a facing 51 are laminated. Lycra tape 50 is further laminated thereon from a center button portion 54 to a collar 55 while the tape 50 is stretched by 1/7 to 1/8 of its length in the longitudinal direction. Furthermore, a collar body portion 56, a collar notch portion 57, a collar notch cut portion 57', a collar notch portion 57, a G collar (reverse collar cloth) 58, a G collar center 59, an upper collar 60 on an opposite side, and a collar notch portion 61 on an opposite side are sequentially sewn by first stitches (collar first stitches) 65 extending to a center button portion 64 on an opposite side, to thereby sew the collar body portion 56, the collar facing 51 and the stretchable tape 50 together.

Next, a Lycra tape is laminated on a peripheral edge of the under-button facing 53 on which the finished thread core piece 52 is adhered while the Lycra tape is stretched by 1/7 to 1/8 of its length in the longitudinal direction. Then, the first stitches 65 are formed on the stretched tape 50 extending to the under-button facing hem 62 to thereby sew the under-button facing 53 and the Lycra tape 50. Accordingly, sewing the respective portions by the first stitches is completed.

Next, second stitches by turned sewing or turned-over sewing are applied to the cloth sewn by the first stitches 65 to complete sewing, and the collar facing and under-button facing are sewn to the main body.

In the collar facing and the under-button facing sewn by the sewing method of the invention, "reverse warping phenomenon" hardly occurs, and the ends of the collar can be sharply formed. Accordingly, the respective portions can be finished extremely beautifully as compared to the conventional sewing method. Further, "pilling phenomenon" and "twist phenomenon" do not occur in the sewing portions.

According to the sewing method of the present invention, even when an unstable cloth such as Tactel cloth, or a smooth cloth such as Burberry cloth and gabardine cloth is sewn, "pilling phenomenon" or "twist phenomenon" does not occur in the sewing portions, and furthermore, "reverse warping phenomenon" does not occur in the joint portion of the collar of the shirt, the collar portion and the under-button facing or the like in the suit. Thus, beautiful and sharp points can be formed at the ends of the collar, and a neatly lined garment can be sewn. Further, since "waved phenomenon" does not occur in the zipper tape portion, smooth operation of the zipper can be achieved.

While the invention has been explained with reference to the specific embodiments of the invention, the explanation is illustrative and the invention is limited only by the appended claims.

What is claimed is:

1. A method for sewing stretchable cloths, comprising:

laminating a first stretchable cloth with a core piece disposed on one side of the first stretchable cloth over a second stretchable cloth, laminating a stretchable cloth tape on one of the first stretchable cloth and the second stretchable cloth while slightly stretching the stretchable cloth tape, providing first stitches on the stretchable cloth tape to combine the stretchable cloth tape and the first and second stretchable cloths with the core piece along edge portions of the first and second stretchable cloths, folding back at least one of the first and second stretchable cloths along the first stitches, and providing second stitches between the first stitches and the edge portions to connect the stretchable cloth tape, the first and second stretchable cloths with the core piece and one of the folded first and second stretchable cloths.

2. A method for sewing stretchable cloths according to claim 1, wherein outer surfaces of the first and second stretchable cloths face each other when the first and second stretchable cloths are laminated, and the stretchable cloth tape is stretched by 1/7–1/8 of an original length thereof.

3. A method for sewing stretchable cloths according to claim 2, wherein said second stretchable cloth is provided with a core piece, said core piece on the second stretchable cloth being sewed by the first and second stitches together with the second stretchable cloth.

4. A method for sewing stretchable cloths according to claim 1, wherein said core piece is a stretchable core piece including stretchable threads fixed to each other to prevent substantial movements of the threads, and is fixed to the first stretchable cloth by an adhesive.

5. A method for sewing cloths according to claim 1, wherein said core piece is formed of two stretchable core pieces woven by stretchable threads fixed to each other to prevent substantial movements of the threads, which are adhered together by an adhesive sheet interposed therebetween.

6. A method for sewing a collar of a garment, comprising:

adhering a first stretchable core piece on a reverse surface of a front collar cloth such that side edges of the first stretchable core piece and the front collar cloth are aligned, laminating stretchable cloth tapes on one of the first stretchable core piece and a reverse collar cloth along two short side edges situated away from each other, providing first stitches on each of the stretchable cloth tapes to connect each of the stretchable cloth tapes to one of the reverse collar cloth and the first stretchable core piece with the front collar cloth while stretching the stretchable cloth tapes, laminating the front collar cloth on the reverse collar cloth such that outer surfaces thereof face each other, providing second stitches along the two short side edges and one long side edge of the front collar cloth and the reverse collar cloth to combine the first stretchable core piece, front collar cloth, reverse collar cloth and stretchable cloth tapes, folding back the front collar cloth and the reverse collar cloth along the second stitches, providing third stitches on outer surfaces of the collar cloths between the second stitches and outer edges of the collar, adhering a second stretchable core piece on the reverse collar cloth along a base portion of the collar, and providing fourth stitches on the second stretchable core piece along the base portion of the collar to combine the second stretchable core piece and the front and reverse collar cloths.

7. A method for sewing a collar of a garment according to claim 6, wherein each of the stretchable cloth tapes is stretched by 1/7–1/8 of an original length thereof.

8. A method for sewing a collar of a garment according to claim 7, further comprising connecting a third stretchable core piece on the first stretchable core piece, and connecting a fourth stretchable core piece on the second stretchable core piece.

9. A method for sewing a collar of a garment according to claim 6, wherein said stretchable cloth tapes are laminated on the first stretchable core piece.

10. A method for sewing a collar of a garment according to claim 6, wherein each of said stretchable cloth and said second stretchable core piece is woven by stretchable threads fixed to each other to prevent substantial movements of the threads.

11. A method for sewing a zipper tape onto main cloths, comprising:

preparing a zipper tape formed of two tape portions, each tape portion having a non-stretchable portion and a stretchable portion situated adjacent to the non-stretchable portion, stretchable threads forming said stretchable portions being woven with non-stretchable threads forming the non-stretchable portion while the stretchable threads are being stretched, attaching teeth of a zipper to said non-stretchable portions, and sewing the stretchable portions onto the main cloths while slightly stretching the stretchable portions to increase a length thereof.

12. A method for sewing a zipper tape according to claim 11, wherein said stretchable portion is sewed to the main cloth while the stretchable portion is stretched by 2 to 4% of an original length thereof.

13. A method for sewing stretchable cloths, comprising:

laminating an elongated stretchable core piece partly on an elongated stretchable cloth along an edge thereof, folding the elongated stretchable cloth to enclose the elongated stretchable core piece, laminating the folded stretchable cloth on a main cloth, and applying first stitches to connect the elongated stretchable core piece, the main cloth and the elongated stretchable cloth while stretching the elongated stretchable cloth and the elongated stretchable core piece.

14. A method for sewing stretchable cloths according to claim 13, wherein said elongated stretchable cloth and the elongated stretchable core piece are stretched by 1/7–1/8 of original lengths thereof when they are sewed to the main cloth.

15. A method for sewing stretchable cloths according to claim 13, further comprising applying zig-zag stitches on the elongated stretchable core piece when the elongated stretchable core piece is laminated on the elongated stretchable cloth.

16. A method for sewing stretchable cloths according to claim 13, wherein an edge portion of the main cloth is enclosed in the folded elongated stretchable cloth.

17. A method for sewing stretchable cloth according to claim 16, wherein a part of the elongated stretchable cloth which does not laminate the elongated stretchable core piece is partly folded, said partly folded elongated stretchable cloth being stitched to the main cloth.

18. A method for sewing stretchable cloths according to claim 16, wherein the first stitches are formed of two straight line stitches on one surface of the elongated stretchable cloth, and zig-zag stitches on the other surface of the elongated stretchable cloth.

19. A method for sewing a collar of a garment according to claim 13, wherein said elongated stretchable core piece is woven by stretchable threads fixed to each other to prevent substantial movements of the threads.

* * * * *